United States Patent [19]

Pfaffmann

[11] Patent Number: 4,704,252

[45] Date of Patent: Nov. 3, 1987

[54] ISOSTATIC HOT FORMING OF POWDER METAL MATERIAL

[75] Inventor: George D. Pfaffmann, Farmington, Mich.

[73] Assignee: Tocco, Inc., Boaz, Ala.

[21] Appl. No.: 926,124

[22] Filed: Nov. 3, 1986

[51] Int. Cl.[4] ..... B22F 1/00

[52] U.S. Cl. ..... 419/49; 219/7.5; 219/8.5; 219/10.41; 219/10.75; 266/44; 266/249; 266/275; 373/138; 373/147; 419/31; 419/48; 419/52

[58] Field of Search ..... 419/31, 48, 49, 52; 266/275, 44, 249; 219/7.5, 8.5, 10.41, 10.75; 373/138, 147

[56] References Cited

U.S. PATENT DOCUMENTS

| | | | |
|---|---|---|---|
| 4,088,258 | 5/1978 | Regalbuto | 419/48 |
| 4,518,441 | 5/1985 | Hailey | 419/48 |
| 4,539,175 | 9/1985 | Lichti et al. | 419/49 |
| 4,601,877 | 7/1986 | Fujii et al. | 419/48 |

OTHER PUBLICATIONS

"A Process for Improved Induction Heating of Powder Metal Compacts", article by Robert L. Conta, 1975, 5 pages.

"Brighter Prospects for GKN Powder Forgings", article in MPR, Feb. 1983, 3 pages.

"Federal-Mogul's Success with 'Sinta Forge' Process", article in MPR, Feb. 1983, 4 pages.

"Pseudo-HIP Using Conventional Presses", article in MPR, Jun. 1983, 3 pages.

"Upsurge in Isostatics", article in American Machinist Special Report 765, Apr. 1984, pp. 99-114.

"Rapid Omnidirectional Compaction", article by Clifford A. Kelto of Kelsey-Hayes, undated, 5 pages.

*Primary Examiner*—Stephen J. Lechert, Jr.

*Attorney, Agent, or Firm*—Body, Vickers & Daniels

[57] ABSTRACT

A crushed powder metal workpiece preform is enclosed in a shell or envelope of a ceramic liquid die material and is inductively heated through the ceramic material and then transferred to a pressure vessel wherein the liquid die material is pressurized to provide a rapid omnidirectional compaction of the powder metal preform and thus a fused powder metal workpiece.

16 Claims, 12 Drawing Figures

$r\uparrow \quad d\uparrow$ $T_1 = r_{g1} = d_1$ (DEEP)

$T_1\uparrow r_{g2}\downarrow \therefore d_2\downarrow$

HEAT $T_1 \rightarrow T_2$

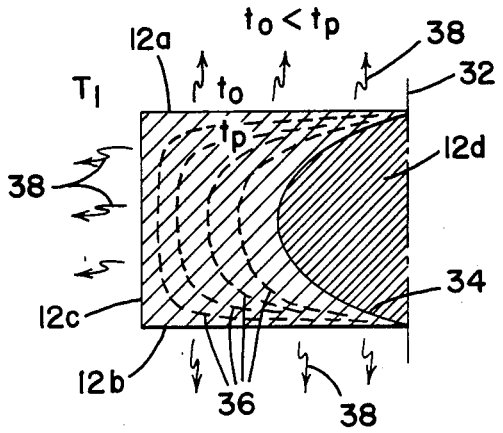
FIG. 6A
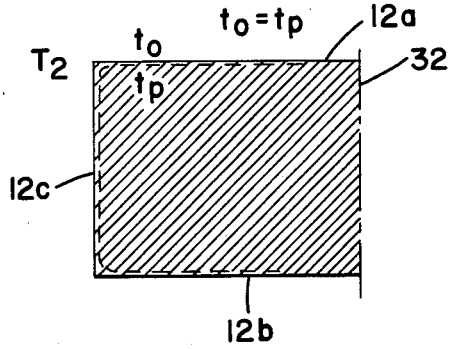
FIG. 6B
FIG. 7
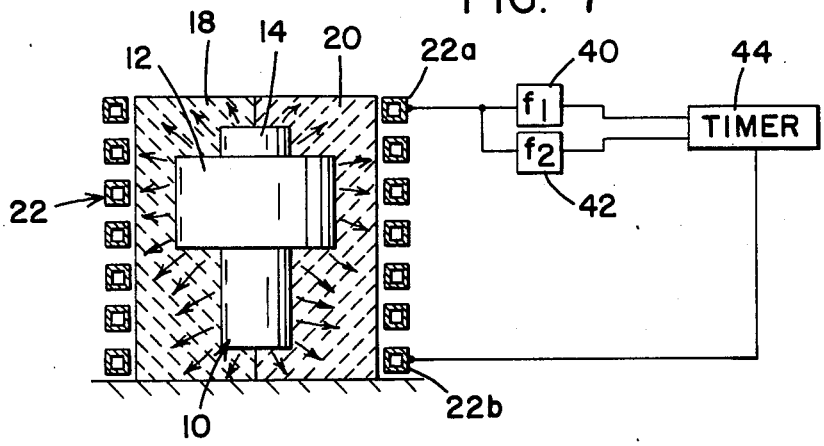

ISOSTATIC HOT FORMING OF POWDER METAL MATERIAL

BACKGROUND

The present invention relates to hot isostatic processing and in particular, to improvements in connection with the heating of powder metal workpiece preforms which are thereafter compressed to form a fused powder metal workpiece.

Hot isostatic processing of various materials is becoming increasingly important in providing articles with properties not otherwise attainable. Generally, such methods employ a compaction of a particulate preform of an article by uniformly compressing the preform at right angles to its exterior surface. This is achieved, for example, by employing as the pressurizing medium a fluid which inherently uniformly acts on the entire outer surface of the preform. This contrasts with uniaxial processes such as pressing, forging, drawing or the like, wherein the forces are substantially axially directed. Hot isostatic compaction produces improved physical characteristics, such as densification, strength, ductility and metallurgical and chemical changes not possible in the uniaxial compaction processes.

Generally, three types of isostatic processes have been utilized: cold isostatic processing (CIP), hot isostatic processing (HIP), and rapid omnidirectional compacttion (ROC). In the CIP process, a wide range of powder metals or ceramics may be isostatically compacted by a fluid medium at near ambient temperatures. Therein, for example, a flexible mold formed in the desired shape is filled with a powder material and placed in the cavity of a pressure vessel. The cavity is filled with fluid and pressurized up to 200,000 psi to achieve the compaction. The HIP process involves the pressurizing of an article such as a preformed unsintered part, a casting, a powder filled container, or the like, in a pressure vessel. An inert gas such as argon or helium is generally used. The vessel is gradually pressurized to about 15,000 to 30,000 psi while the part is heated at a predetermined temperature for a time sufficient to effect the desired densification and metallurgical and chemical changes. Thereafter, the vessel is gradually depressurized. While the process produces parts to final shape, avoids separate sintering and finishing operations and provides unique properties, the process cycle is extremely lengthy and costly.

In the ROC process, a powder metal workpiece preform is disposed in a ceramic shell or envelope, heated to a desired elevated temperature and then placed in a pressure vessel and pressurized to compact the preform. The ceramic shell acts as a liquid die material and, when placed in a suitable pressure vessel and pressurized such as by the use of a hydraulic ram, the ceramic material is rapidly pressurized in a short time interval. The preform is thus rapidly isodynamically pressurized and consolidated. The pressure may be rapidly released resulting in an extremely short cycle, namely seconds as compared to hours for the HIP process. Moreover, by heating the enveloped preform outside the pressure vessel, the size and construction of the pressure vessel is reduced and simplified. Heretofore, however, an external furnace has been necessary for the heating, and extended heating times have been required because of the low thermal conductivity of the ceramic enveloping the powder metal preform. The extended heating cycle is detrimental to the physical properties of the compressed workpiece. More particularly in this respect, the prior method and apparatus result in a compressed workpiece which has an undesirably low fracture resistance due to grain growth and particle separation resulting from extended heating.

BRIEF SUMMARY OF THE INVENTION

The present invention provides improvements in connection with an isostatic ROC process overcoming the above deficiencies and limitations. More particularly in accordance with the invention, apparatus and methods are provided using inductive heating in a manner substantially reducing the overall cycle time and attendant heating costs while reducing grain growth and particle separation in the powder metal workpiece preform such that the compressed workpiece is more fracture resistant than with previous methods and apparatus. In accordance with one aspect of the invention, these attributes are achieved by inductively heating a crushed powder metal workpiece preform enclosed in a ceramic shell or envelope, whereby the workpiece preform is heated directly through the ceramic material, and then transferring the heated workpiece preform to a pressure vessel wherein the ceramic liquid die material is pressurized such as by a hydraulic ram to provide a rapid omnidirectional compaction of the powder metal preform and thus a fused powder metal workpiece. The crushed powder metal material of the preform has a high electrical resistivity, and by inductively heating the preform through the use of low frequency current the preform is inversely heated from the inside out. Such heating of the preform is rapid and results in uniform heating of the preform without having to heat the ceramic material to the corresponding high temperature as is necessary when heating the preform in a furnace. Thus, it is not necessary to provide the ceramic material with high temperature characteristics as heretofore required. Moreover, it is believed that heating of the ceramic material by conduction of heat from the workpiece preform in accordance with the present invention improves the dimensional stability of the ceramic in comparison with prior methods. In this respect, such dimensional stability decreases with an increase in temperature and thus decreases in connection with the prolonged or extended heating cycle required in connection with prior methods and apparatus. It is further believed that the reduced heating of the ceramic material in accordance with the present invention not only improves its mechanical stability but also improves its functions as a liquid die material during the compression of the workpiece preform. In this respect, it is suspected that the adjustments to the composition of the ceramic to improve its stability at high temperature may compromise its functions as a liquid die material.

As mentioned above, the high resistivity of the crushed powder metal of the workpiece preform and the use of low frequency current in the audio frequency range for heating results in initial deep heating radially inwardly of the workpiece preform and an inverse heating pattern which progresses radially outwardly of the workpiece preform. Further, the crushed character of the powder metal of the preform results in the latter having a low thermal conductivity. The resistivity of the crushed powder metal decreases as.the temperature increases, and it is believed that it is the net result of the resistivity and conductivity characteristics which enables obtaining the inverse heating pattern and the generally uniformly progressive heating from the core or center of the workpiece preform to the outer surface thereof and, thus, a uniform temperature of the workpiece preform. These desirable attributes are obtained with a shorter heating time than is required in connection with a furnace heating procedure and, additionally, such inductive heating of the workpiece preform is advantageously achieved with minimal heating of the ceramic material thereabout, whereby the dimensional stability of the latter is maintained to optimize its functions as a liquid die material during the compressing of the workpiece preform following the heating thereof.

It is accordingly an outstanding object of the present invention to provide improved ROC methods and apparatus for heating and compressing powder metal workpiece preforms.

Another object is the provision of improved methods and apparatus of the foregoing character by which grain growth and separation in the preform is minimized whereby the compressed powder metal workpiece produced has improved fracture resistance.

A further object is the provision of improved methods and apparatus of the foregoing character wherein a ceramic material enveloping the powder metal workpiece preform and acting as a liquid die material during the compressing of the preform is maintained dimensionally stable during heating of the powder metal preform.

Yet a further object is the provision of improved methods and apparatus of the foregoing character in which the time required to heat a powder metal workpiece preform is substantially reduced, whereby the time required to produce a completed compressed powder metal workpiece is reduced, and wherein the apparatus for heating and compressing is of reduced complexity and cost.

Still another object of the invention is the provision of methods and apparatus of the foregoing character utilizing induction heating for improved productivity and improved characteristics of end products produced.

BRIEF DESCRIPTION OF THE DRAWING

The foregoing objects, and others, will in part be obvious and in part pointed out more fully hereinafter in conjunction with the written description of preferred embodiments illustrated in the accompanying drawing in which:

FIGS. 6A and 6B illustrate the inverse heating profile of the powder metal workpiece preform portion of the workpiece:

FIG. 7 is a sectional elevation view illustrating an alternate arrangement for inductively heating the powder metal workpiece preform portion of the workpiece; and, FIG. 8 is a sectional elevation view illustrating an arrangement for heating the powder metal workpiece preform and the ceramic material enveloping the workpiece.

DESCRIPTION OF PREFERRED EMBODIMENTS

Figure 1:
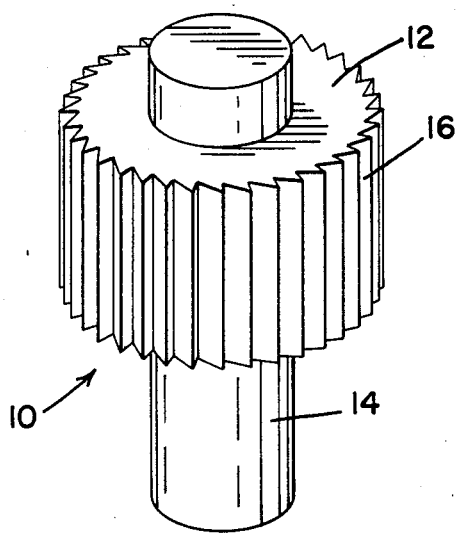
FIG. 1 is a perspective view of an exemplary workpiece to be processed in accordance with the present invention.

Referring now in greater detail to the drawings wherein the showings are for the purpose of illustrating preferred embodiments of the invention only and not for the purpose of limiting the invention, FIG. 1 illustrates a workpiece 10 in the form of a cutting tool such as a reamer and which is exemplary of a workpiece which can be processed in accordance with the present invention to produce such a tool as an end product of the process. Workpiece 10 for such a tool includes a body portion 12 of compacted powder metal material such as tool steel or tungsten carbide, for example, mounted on a core or shaft 14 of soft iron, for example, and having cutting teeth 16 extending about the outer periphery thereof. Body portion 12 is initially in the form of a compacted, crushed powder metal having a density of about 70% to 80% and which is compacted in place around the solid shaft 14. The compacted powder metal defines a powder metal workpiece preform portion of the workpiece and the preform is initially of an oversized dimension axially and radially relative to such dimensions for the end product. While the powder metal workpiece preform defined by body portion 12 of the workpiece is shown mounted on a shaft or core 14, it will be appreciated that the use of a shaft or core is not necessary in accordance with the present invention and will depend on the article being produced, as will the specific configuration of body portion 12.

Figure 2:
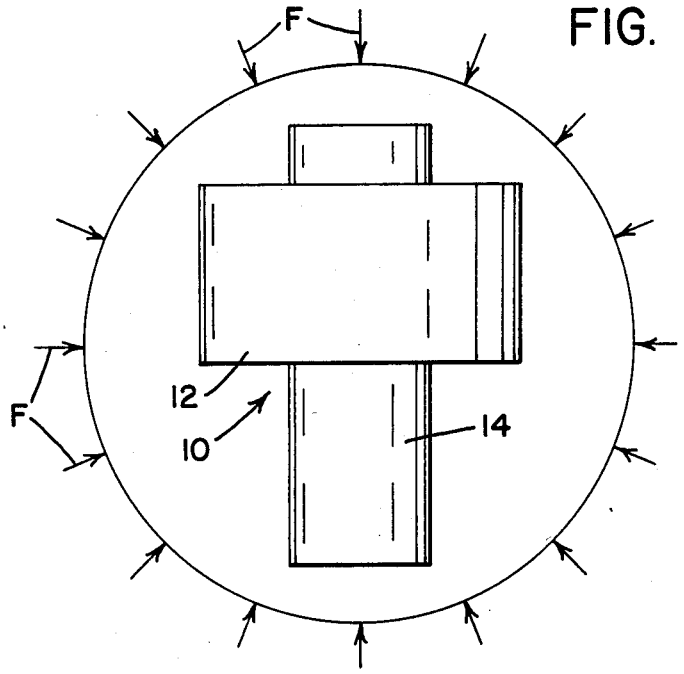
FIG. 2 is an elevation view of the workpiece schematically illustrating the omnidirectional application of force thereon during compressing of the powder metal workpiece preform portion thereof.

As is known in connection with the rapid onmidirectional compressing of powder metal preforms, and as will become apparent hereinafter, compression of the heated powder metal workpiece preform applies forces simultaneously in all directions relative to the preform as is schematically illustrated by arrows F in FIG. 2 with respect to workpiece 10, whereby the powder metal workpiece preform 12 is compressed and reduced in size in all directions simultaneously.

Figure 3A:
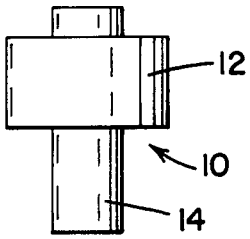
FIGS. 3A–3D are elevation views, partially in section, illustrating the sequence of operations in processing the workpiece in accordance with the present invention.
Figure 3B:
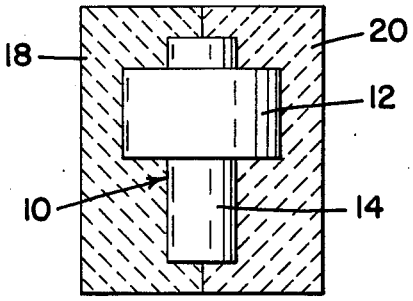

FIGS. 3A–3D somewhat schematically illustrate the process by which workpiece 10 and the compacted workpiece preform portion 12 thereof is processed in accordance with the present invention to produce the final product. More particularly in this respect, FIG. 3A illustrates the workpiece preform portion 12 compacted about shaft 14, and FIG. 3B illustrates the workpiece enclosed within a cylindrical ceramic envelope comprised of halves 18 and 20, each of which is recessed interiorly so that they together provide a cavity corresponding to the dimensions and contour of workpiece 10. The ceramic material, in connection with a rapid omnidirectional compression process, is often referred to as a liquid die material in that it is adapted upon rapid compression following heating of the compacted powder metal preform portion of the workpiece to provide the omnidirectional application of force to the latter as illustrated in FIG. 2. In other words, as will be appreciated from FIGS. 2 and 3B, the ceramic material acts as a pressure transfer medium when the workpiece and ceramic envelope are ultimately subjected to a consolidation pressure following heating of the compacted workpiece preform.

Figure 3C:
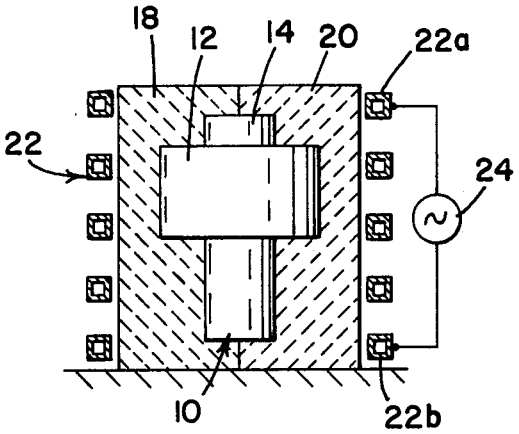
Figure 3D:
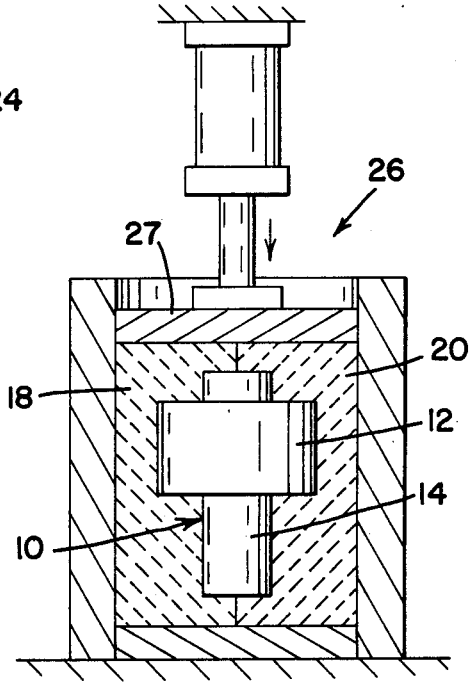

FIG. 3C represents the heating step according to the present invention, and which will be described in greater detail hereinafter, and in this respect illustrates the ceramic envelope and workpiece coaxially positioned within a multiturn tubular inductor coil 22 having its opposite ends 22*a* and 22*b* connected across a power source 24. As is well known in the art, coil 22 is tubular in cross-section to facilitate the circulation of coolant therethrough and it will be appreciated that the coil has appropriate connections to a source of coolant, not shown, for this purpose. Following heating of the compacted powder metal workpiece preform portion 12 as described hereinafter, the ceramic envelope and workpiece are quickly transferred to a press, such as the hydraulic press 26 somewhat schematically illustrated in FIG. 3D. Therein, the ceramic envelope and workpiece are subjected to high pressure through the actuation of hydraulic ram 27 for a short period of time to achieve omnidirectional compression of workpiece preform portion 12 to its final configuration. Thereafter, workpiece 10 is removed from the press and cooled.

The compacted powder metal workpiece preform portion 12 of workpiece 10 has to be heated to an effective sintering temperature of about 2,000° F. prior to the compression thereof in press 26. In connection with the present invention, it has been discovered that the crushed powder metal body portion preform can be rapidly and uniformly heated to the desired temperature, inductively, and that the latter can be achieved independently of concern for heating the ceramic liquid die material, whereby the heating process is considerably reduced in time relative to the furnace heating heretofore required. Further in this respect, the composition of the ceramic, namely the percentage of glass therein, can be altered to give the material the proper liquid characteristics under pressure without the necessity of heating the latter and, possibly, without any compromise to its functions as a liquid die material.

Figure 4:
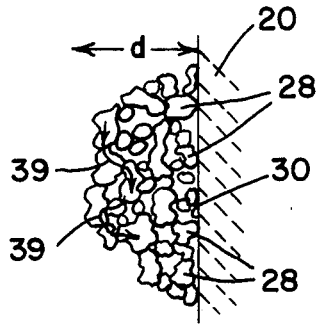
FIG. 4 is a schematic representation of the grain structure of the compacted powder metal workpiece preform portion of the workpiece.
Figure 5:
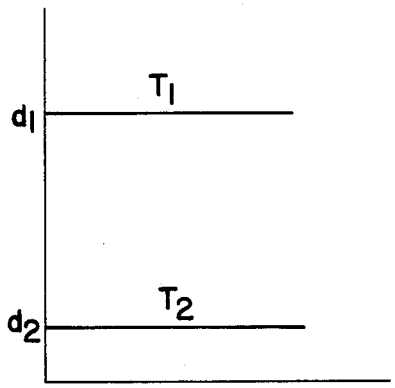
FIG. 5 is a diagram illustrating the relationship between the temperature and depth of heating of the powder metal workpiece preform portion of the workpiece.

More particularly in connection with heating crushed powder metal workpiece preform portion 12 in accordance with the present invention, and with reference to FIGS. 4 and 5 of the drawing, the compacted preform is comprised of irregularly sized and shaped powder metal grains 28 and the preform has a depth dimension d relative to and radially inwardly from the adjacent surface 30 of the ceramic envelope material. Relating surface 30 to FIG. 3C, for example, and considering the ceramic material to be the material of envelope half 20, dimension d would extend radially inwardly toward core 14 from the radially outer wall of the cavity in envelope portion 20 receiving workpiece preform portion 12. The powder metal material has an electrical resistivity r which decreases as the temperature of the powder metal increases, and it was discovered that by inductively heating the preform in the manner illustrated in FIG. 3C using a low frequency power source in the range of from 1 to 10 KHz, the preform is heated inversely, namely from the core side of the preform radially outwardly toward the ceramic material. Such inverse heating has a beneficial effect on energy distribution within the powder metal preform and results in a more uniform temperature following the heating step and a shorter heating time.

It is believed that a significant factor in connection with such inverse heating and the effect thereof results from the use of crushed powder metal. In this respect, the compacted workpiece preform portion has good mechanical or green strength, and this is achieved, without the need for any binders, and without the need for singering, whereby there is no defusion or mechanical fusing of the particles. This is believed to contribute to the inverse heating results as set forth hereinafter.

Referring further to FIGS. 4 and 5, in connection with the heating of the crushed powder metal preform from a first temperature $T_1$ to a higher temperature $T_2$, the powder metal grains have an initial high electrical resistivity $r_{g1}$, and the low frequency induction heating results in initially heating the powder metal preform at a depth $d_1$ adjacent the radially inner side of the powder metal preform. As the temperature of the powder metal increases, the resistivity of the corresponding powder metal grains decreases as represented by $r_{g2}$, whereby the depth of heating progressively moves radially outwardly to a second depth $d_2$ which is closer to the radially outer side of the preform. Therefore, as the temperature progressively increases from $T_1$ to the higher temperature $T_2$, the depth of heating progressively decreases toward the radially outer side of the preform. Such progressive inverse heating is diagrammatically illustrated in FIGS. 6A and 6B wherein reference line 32 represents the radially inner side of the powder metal preform relative to core or shaft 14, numerals 12*a* and 12*b* represent axially opposite sides of powder metal preform 12, and numeral 12*c* represents the radially outer side of the preform, all of which sides are of course adjacent portions of the ceramic envelope. Further in FIGS. 6A and 6B, $t_o$ and $t_p$ respectively represent the temperatures outwardly and inwardly adjacent the surfaces of the preform. At temperature $T_1$, the outer surface temperature $t_o$ is less than the inner surface temperature $t_p$ and, as represented by solid line 34 in FIG. 6A, the radially inner portion 12*d* of the preform within line 34 is at temperature $T_1$. As the temperature increases towards temperature $T_2$ the heating pattern progresses radially outwardly as represented by broken lines 36 in FIG. 6A until, as represented in FIG. 6B, the powder metal preform is uniformly heated to temperature $T_2$ and the temperatures of the outer and inner surfaces $t_o$ and $t_p$ thereof are equal.

As will be further appreciated from FIG. 6A, and as represented therein by arrows 38, the inductive heating of powder metal preform results in the emanation of heat therefrom and thus the heating of the ceramic material thereabout by conduction. However, since the metal particles of the preform are not sintered and thus are not fused together, the conduction of heat between particles is along erratic and irregular paths as represented by arrows 39, whereby the preform has a low thermal conductivity. This is believed to contribute to the obtaining of a substantial depth of initial heating and the progressive inverse heating to a uniform temperature as described. Thus, while the ceramic shell is heated by conduction, such heating of the shell is not necessary, as pointed out above, and the low thermal conductivity promotes heating of the powder metal preform in accordance with the present invention.

When the temperature of the powder metal preform has been elevated to 2,000° F., which can be achieved by timed energization of coil 22 at a particular frequency within the range set forth hereinabove, the workpiece and ceramic envelope are quickly transferred to press 26 which is then actuated to compress the ceramic material so as to apply an omnidirectional pressure of about 60,000 psi on preform 12 for a short period of time such as one second. Such pressure compresses the powder metal preform to a higher density than the initial density of the compacted powder metal and sinters the latter, and it will be appreciated that the process from heating to removal of the product from the press is achieved in a matter of seconds as compared to several hours when the workpiece is heated in a furnace.

It may be desirable under certain circumstances dependent on factors such as the particular powder metal being used, grain size, density of the compacted workpiece preform, or the like, to inductively heat the powder metal preform in the manner indicated hereinabove but at different frequencies within the range set forth herein. This can be achieved, as illustrated in FIG. 7 for example, by connecting power sources 40 and 42 respectively having frequencies $f_1$ and $f_2$ across inductor ends 22*a* and 22*b* through a timing switch 44 operable to connect first one and then the other of the power sources across the coil for predetermined time periods. For example, power source 40 could operate at a freuqnecy of from 1 to 5 KHz and power source 42 at a frequency of from 5 to 10 KHz. In accordance with the heating of a powder metal workpiece preform in accordance with the present invention, power source 40 would first be connected across coil ends 22*a* and 22*b* to first inductively heat the powder metal preform at the deepest or radially innermost area thereof and for a predetermined period of time for the heating to progress outwardly to some extent and, at the end of such predetermined time, timer 44 would operate to disconnect power source 40 and to connect power source 42 across the coil ends for a second predetermined period of time and at the higher frequency of power source 42 to complete the heating of the workpiece preform. It will be appreciated that the foregoing frequency ranges are given by way of example only and that other ranges can be used. Moreover, it will be appreciated, for example, that the initial frequency could be in the range of 1–10 KHz and the second frequency in a higher range. Such use of power sources of different frequency would provide for switching to the higher frequency when the electrical resistivity of the powder metal becomes reduced to the point where the higher frequency would promote a more rapid heating of the radially outer portions of the workpiece preform, thus to optimize minimum heating time and uniform heating without over heating a portion of the preform.

Figure 8:
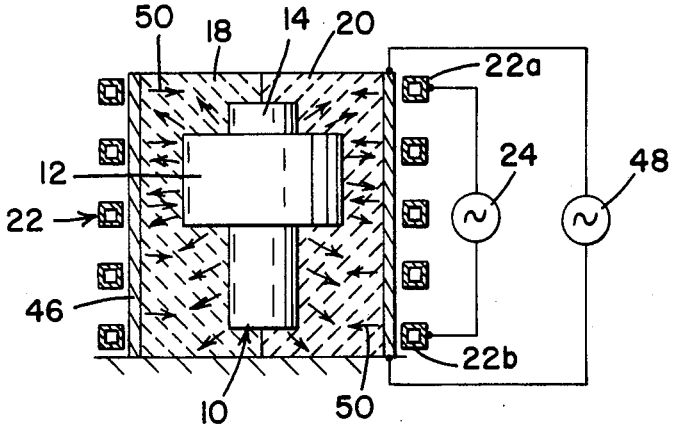

While it has been found, as described hereinabove, that it is not necessary to heat the ceramic material to achieve the desired liquid die characteristics therefor in connection with the compression of the workpiece preform in press 26, it is possible to do so in connection with the present invention while obtaining the inverse heating of the powder metal preform as described hereinabove. In this respect, with reference to FIG. 8 of the drawing, the ceramic envelope defined by envelope halves 18 and 20 can be disposed in a metal sleeve, or susceptor 46 connected across a power source 48, whereby the susceptor becomes a resistance type heating element in response to energizing power source 48. Accordingly, when power source 48 is energized, the ceramic envelope is heated about the outer periphery thereof, and such heat is conducted inwardly of the envelope toward workpiece 10, as indicated by arrows 50. The susceptor can be of any suitable metal such as thin stainless steel. Energization of power source 48 can be simultaneous with energization of inductor 22 or independent thereof. At an elevated temperature the ceramic material becomes conductive whereby, if both power sources are energized, the material can be further heated inductively by means of coil 22, and power supply 48 can be deenergized if desired. Following heating to the desired temperature, the ceramic envelope and workpiece are transferred to and compressed in a suitable pressure vessel as described hereinabove. It will be appreciated, of course, that the composition of the ceramic material in connection with such heating thereof to a high temperature corresponding to that of the preform would be altered to provide the necessary mechanical stability thereof at elevated temperatures for the ceramic to have the proper liquid die characteristics under pressure.

While considerable emphasis has been placed herein on the heating of crushed powder metal workpiece preforms surrounded by a ceramic liquid die material, or the heating of such a preform and the surrounding ceramic material in preparation for the rapid omnidirectional compressing of the powder metal preform into a sintered high density product, the principals of heating the powder metal preform in accordance with the present invention may be applicable to the heating of powder metal workpiece preforms of spherical powders which, because of the inability to compact and produce an acceptable green strength, are sealed in a metal container having the desired configuration for the workpiece preform. In connection with the present invention, it is believed that such a contained preform, disposed in an envelope of ceramic liquid die material as described herein, could be inductively heated in a manner which is basically a variation of the susceptor arrangement described above in connection with FIG. 8. In this respect, the metal container for the spherical powder would be disposed within the ceramic envelope which would be surrounded by the inductor coil in the manner illustrated in FIG. 3C of the drawing. By energizing the inductor, the metal container would be inductively coupled therewith and heated, whereby the spherical powder metal within the container would be initially heated by conduction through contact with the container. As the temperature of the container and thus the spherical powder metal therein increases, the reflected electrical aggregate resistivity of the powder metal would decrease to a point where it would start to conduct and accept induction heating. Various frequencies of the induction heating power source could be used to enhance the heating process. In this respect, for example, a higher frequency could be used initially to inductively couple with the metal container, followed by a lower frequency to couple with the powder metal through the container when the powder metal reaches the point at which it will accept induction heating.

It will be appreciated that many embodiments of the present invention can be made and that any modifications can be made in the embodiments described herein, without departing from the principals of the present invention, whereby it is to be distinctly understood that the foregoing descriptive matter is to be interpreted merely as illustrative of the present invention and not as a limitation.

Having thus described the invention, it is claimed:

1. Apparatus for the rapid omnidirectional compressing and sintering of a workpiece preform of compacted powder metal enveloped in a ceramic liquid die material, said preform having a given density and radially inner and outer portions relative to said ceramic liquid die material, inductor means and audio frequency power source means to energize said inductor means for progressively inductively heating said preform from said radially inner portion toward said radially outer portion and to a temperature at which said compacted powder metal of said preform can be compressed and sintered, and means for pressing said ceramic liquid die material with said preform therein for said liquid die material to omnidirectionally compress said preform to a density higher than said given density.

2. Apparatus according to claim 1, wherein said inductor means includes inductor coil means adapted to coaxially receive said enveloped workpiece preform therein.

3. Apparatus according to claim 2, wherein said power source means includes means to sequentially energize said inductor means at first and second different frequencies.

4. Apparatus according to claim 3, wherein said first frequency is lower than said second frequency.

5. Apparatus according to claim 1, wherein said ceramic liquid die material has an outer surface, and means to heat said material from said outer surface toward said workpiece preform.

6. Apparatus according to claim 5, wherein said means to heat said material includes resistance heating means, and means to energize said resistance heating means.

7. Apparatus according to claim 6, wherein said resistance heating means includes metal susceptor means extending about said material coaxial with said workpiece preform.

8. A method of producing a compressed and sintered powder metal product from a workpiece preform of compacted powder metal having a given density and radially inner and outer portions, comprising enclosing said preform in envelope means of ceramic liquid die material, inductively heating said enveloped preform progressively from said inner portion toward said outer portion and to an effective sintering temperature for the powder metal of said preform, and rapidly pressurizing said liquid die material with said heated preform therein to a pressure whereby said material omnidirectionally compresses said preform to a density higher than said given density.

9. A method according to claim 8, and cooling said enveloped preform and removing said compressed preform from said envelope means.

10. A method according to claim 8, wherein said inductive heating of said enveloped preform is by inductor means energized at a frequency of between from 1 to about 10 KHz.

11. A method according to claim 8, wherein said inductive heating of said enveloped preform is by inductor means sequentially energized at a first frequency and then at a second frequency higher than said first frequency.

12. A method according to claim 11, wherein said first and second frequencies are within the range of from 1 to about 10 KHz.

13. A method according to claim 8, wherein said induction heating of said enveloped preform is by inductor means energized in the audio frequency range.

14. A method according to claim 8, wherein said envelope means has an outer surface, and heating said material of said envelope means in the direction from said outer surface toward said preform.

15. A method according to claim 14, and heating said material in said direction by resistance heating means.

16. A method according to claim 14, and surrounding said envelope means coaxially of said preform with metal susceptor means, and electrically energizing said susceptor means for the latter to heat said material in said direction.

* * * * *